US008079489B1

(12) United States Patent
Welch

(10) Patent No.: US 8,079,489 B1
(45) Date of Patent: Dec. 20, 2011

(54) CONTAINER AND BAG SYSTEM WITH DETACHABLE PARTITION

(76) Inventor: Bryan Raymond Welch, Waterbury, CT (US)

( * ) Notice: Subject to any disclaimer, the term of this patent is extended or adjusted under 35 U.S.C. 154(b) by 145 days.

(21) Appl. No.: 12/357,542

(22) Filed: Jan. 22, 2009

Related U.S. Application Data

(60) Provisional application No. 61/066,966, filed on Feb. 26, 2008.

(51) Int. Cl.
*B65D 25/14* (2006.01)
*B65D 90/00* (2006.01)

(52) U.S. Cl. ..... 220/495.04

(58) Field of Classification Search ..... 220/495.04, 220/529, 531, 651, 652; 206/586
See application file for complete search history.

(56) References Cited

U.S. PATENT DOCUMENTS

| | | | | |
|---|---|---|---|---|
| 5,492,241 | A * | 2/1996 | Barnett et al. | 220/694 |
| 6,015,063 | A * | 1/2000 | Poliquin | 220/495.04 |
| 6,298,994 | B1 * | 10/2001 | Debrunner et al. | 206/600 |
| 6,554,151 | B1 * | 4/2003 | Brennan | 220/495.04 |
| 2004/0084456 | A1 * | 5/2004 | Lubrano | 220/495.04 |

* cited by examiner

*Primary Examiner* — Harry Grosso
(74) *Attorney, Agent, or Firm* — Norman B. Rainer

(57) ABSTRACT

Methods, devices, and systems for improved trash containers with liners and a vented divider is described. The vented divider is installed in one corner of the container to facilitate air inlet such that the bag is easier to retrieve even when full. For reasons of utility and aesthetics the divider has plurality of inlets at the bottom instead of a single inlet. The divider also includes an access member, a pair of parallel flexible hinges also known as living hinges as well as a holder for a prior art air freshener. Means for easy installation and removal and reinstallation in a new trash container are also provided.

6 Claims, 6 Drawing Sheets

300

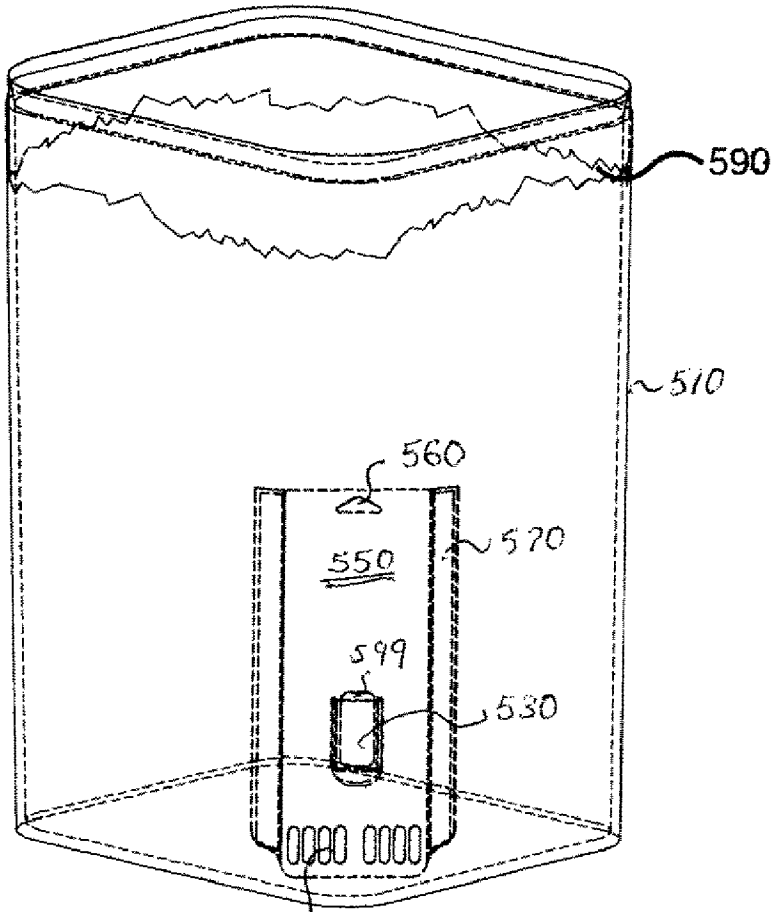
FIG.- 5B
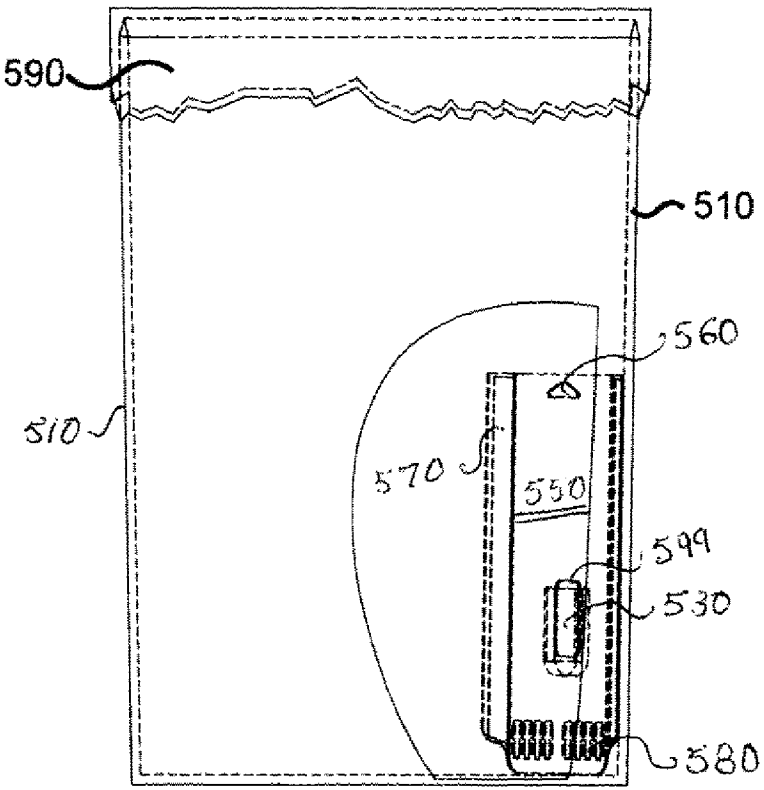
FIG.- 5A
FIG.- 5
500

CONTAINER AND BAG SYSTEM WITH DETACHABLE PARTITION

RELATED DOCUMENT

This Application is based on a provisional application Ser. No. 61/066,966 filed on Feb. 26, 2008 by the same inventor and was then entitled as, "Attachable Vent for Container" and the applicant hereby claims priority there from.

BACKGROUND

This invention relates generally to the art of containers. More particularly it relates to trash containers. Even more particularly it relates to trash containers with insertable flexible bag. The improvement in this invention comprises insertion of a divider in one corner of the container to facilitate air inlet such that the bag is easier to take out even when full. For reasons of utility, safety and aesthetics the divider has plurality of inlets at the bottom instead of a single large air inlet. An added advantage of this approach is also the bag does not get caught in this plurality of small vents, whereas there is considerable risk of a corner of the bag getting caught in the single large vent.

THE PROBLEM

The problem with prior art trash containers is that they are of a fixed design; do not provide any means for air inlet which in turn makes it much harder to remove a full bag of trash in the container. The bag also often binds due to lack of air inlet.

SUMMARY

This invention teaches methods, devices, and system for improved trash containers. Specifically the improvement in this invention comprises insertion of a divider in one corner of the container to facilitate air inlet such that the bag is easier to take out even when full, whereas without any inlet for the air, the bag is that much harder to pull out. For reasons of utility and aesthetics the divider has plurality of inlets at the bottom instead of a single inlet. The reason for this will become obvious from the details in this specification. An added advantage of this approach is also the bag does not get caught in this plurality of small vents, whereas there is considerable risk of a corner of the bag getting caught in the single large vent.

PRIOR ART

A preliminary prior art patentability and novelty search was not conducted. However the inventor is intimately familiar with the prior art but is not aware of any prior art that is directly relevant to this. The closest prior art the applicant is aware of is U.S. Pat. No. 4,294,379 awarded to Robert A. Bard of New Jersey on Oct. 13, 1981 for "Upward Vented Trash Receptacle for Flexible, Collapsible Trash Liner" which does not deal with the problem of odors, bags ripping, hardship in taking out of the container due to lack of ventilation for the air intake, etc.

DISCUSSION OF PRIOR ART

Containers for holding garbage and trash such as FIG. 1 (a container) often used with removable liners or bags such as plastic garbage bags such as FIG. 5 (a liner). When the bags are full of garbage the plastic liner forms a seal with the side of the garbage containers, making the bag difficult to remove. A construction is known in the prior art in U.S. Pat. No. 4,294,379 issued Oct. 13, 1981 to Bard, in which a plurality of tubes are provided in the corners of a rectangular garbage container. The tubes are open at the top and bottom, so that air can flow in both directions between the outside and the sealed space beneath the removable liner.

Bard provides tubes which are integral with the container, they may also be molded separately and attached with adhesive. This is difficult to fit into containers with different curvatures at the corners, or into round containers. There are a number of other different patents pertaining to this art all of which are either too expensive to manufacture, do not work well enough to be sold to the masses, or are not universal enough to work in almost every container. This is why I have developed this idea. This new way of producing this idea makes it inexpensive to produce, it works as well as it's supposed to, and it is universal enough to fit almost any container.

Problems with prior art trash container with liner bag type devices can be summarized as follows.

a) No means of quickly and easily inserting and removing trash bag from the trash container, without ripping or otherwise damaging the bag.

b) Neither cost effective nor affordable.

c) Not intuitive or automatic to use and operate.

e) Not simple, elegant sleek design f) Not air tight, waterproof and odor proof.

g) Not easy to manufacture h) Not aesthetically integrated into the environment i) Do not prevent spillage or escape of trash especially during ingress and egress of the trash bag into or from the trash container respectively j) Not suitable for people with special needs such as elderly requiring the use of cane.

k) No means for venting l) Not suitable for use in inclement weather such as snow, rain, hail, ice, m) Not suitable for long rough dark drive ways n) Not user friendly nor easy to store o) Prior art devices are not readily marketable thru the Internet.

OBJECTIVES

At any rate none of the prior art devices known to the applicant or his attorney disclose the exact embodiment of this inventor that constitutes a simple, elegant, quick, convenient, affordable means. The objects of the invention have been included vis-a-vis the caveat in view of the implication in Gentry v Berkline 134 F.3d 1473 (Federal Circuit, 1998).

Unfortunately none of the prior art devices singly or even in combination provides all of the features established by the inventor for this system as enumerated below.

OBJECTIVES

Accordingly following are the objectives established by the inventor for his invention which is a universal inexpensive way to turn almost any ordinary container into a vented container.

1. It is an objective of this invention to provide methods, devices and system for conveniently inserting and removing a bag of trash in the container of this invention.

2. Another objective of this invention is to provide a simple, affordable and elegant method of quickly attaching and detaching the divider, such that the divider can be easily removed and reused with another container as the old container is no longer of satisfactory utility or aesthetics.

3. Another objective of this invention is to provide a substantial waterproof system made with water resistant materials.

4. Another objective of this invention is to provide a means for conveniently stacking plurality of containers of this invention in tandem or lateral relationship for storage.

5. Another objective of this invention is to provide a system that is made of modular components 6. Another objective of this invention is that it can be manufactured and maintained with ease.

7. Another objective of this invention is to make it suitable for a broad range users and situations.

8. Another objective of this invention is to provide a slick and slim design to match to blend into the aesthetics of the container 9. Another objective of this invention is to provide a design, which can be adapted for other applications such as a do it yourself kit.

10. Another objective of this invention is that its design is simple and even elegant so as to complement the environment around it whether in use or storage or display the point of sale.

11. Another objective of this invention is that its use is intuitive and even user transparent such that it requires no additional training.

12. Another objective of this invention is that it be capable of multiple uses.

13. Another objective of this invention is that it uses little or no additional energy except the human energy of the user and the energy of the motor vehicle.

14. Another objective of this invention is that the invention be user friendly with standard modular components.

15. Another objective of this invention is that it be reliable such that it practically never fails and requires little or no maintenance and has high MTBF.

16. Another objective of this invention is that it be environmentally friendly and user friendly.

17. Another objective of this invention is that it be physically safe in normal environment as well as accidental situations.

18. Another objective of this invention is that it be long lasting made from durable material.

19. Another objective of this invention is that it meets all federal, state, local and other private standards guidelines, regulations and recommendations with respect to safety, environment, and energy consumption.

20. Another objective of this invention is that can be easily scaled up or down in size.

21. Another objective of this invention is that one size fits all types of containers especially classic 65 and classic 95 refuse carts 22. Another objective is to facilitate its use in adverse conditions & circumstances such as long dark driveways full of plurality of potholes and inclement weather including rain, snow, hail ice etc.

23. Another objective of this invention is to serve a much larger market.

24. Another objective of this invention is to reduce the operational cost of system of this invention by employing the natural laws of physics.

25. Another objective of this invention is to provide room for "Drop-In" standard air freshener Other objectives of this invention reside in its simplicity, elegance of design, ease of manufacture, service and use and even aesthetics as will become apparent from the following brief description of the drawings and the detailed description of the concept embodiment.

Unfortunately none of the prior art devices singly or even in combination provides all of the features established by the inventor for this system as enumerated below.

a) Easy In Easy Out operation
b) Safe, Secure, Simple and Elegant Sleek Lightweight Design
c) Affordable and Cost effective as well as Long Lasting and Durable
d) Easy to manufacture, use, operate and maintain with low life cycle cost.
e) One-person operation without assistance of another person.
f) User Friendly & intuitively easy to install, operate, hook & unhook in a hurry.
f) Requires no additional training
g) Suitable for people of all ages and gender in all types of situations.
h) Multiple uses in a wide range of situations and circumstances.
i) Easily saleable up and down and easily adaptable for other uses.
j) One size fits all.
k) Water resistant or even waterproof
l) Safe in long dark driveways
m) Safe in adverse weather conditions
n) Safe on driveways with plurality of pot holes
o) Easily permits hauling of all types of containers
a) Facilitates attaching plurality of containers in tandem or in lateral relationship to each other.

BRIEF DESCRIPTION OF THE DRAWINGS

These objects and features of the invention shall now be described in relationship to the following drawings, which are integral part of these specifications.

a) FIG. 1-A is a 3 D isometric perspective of the trash container of this invention with the divider in dotted lines diagonally position at the bottom of one corner of the trash can.

Figure 1B:
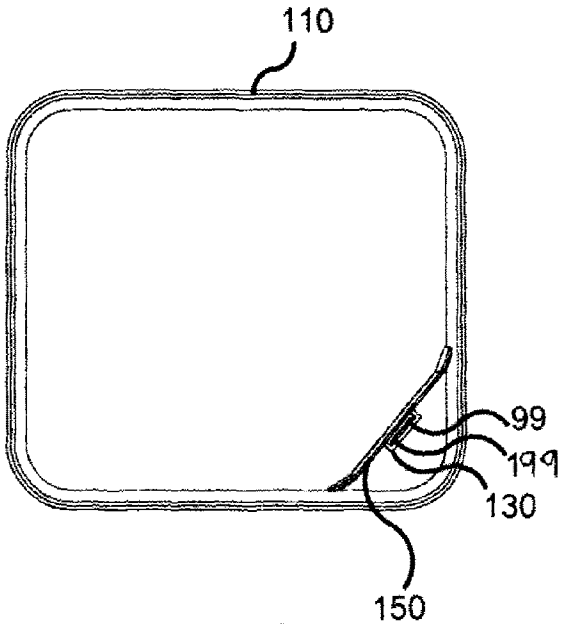
Figure 1A:
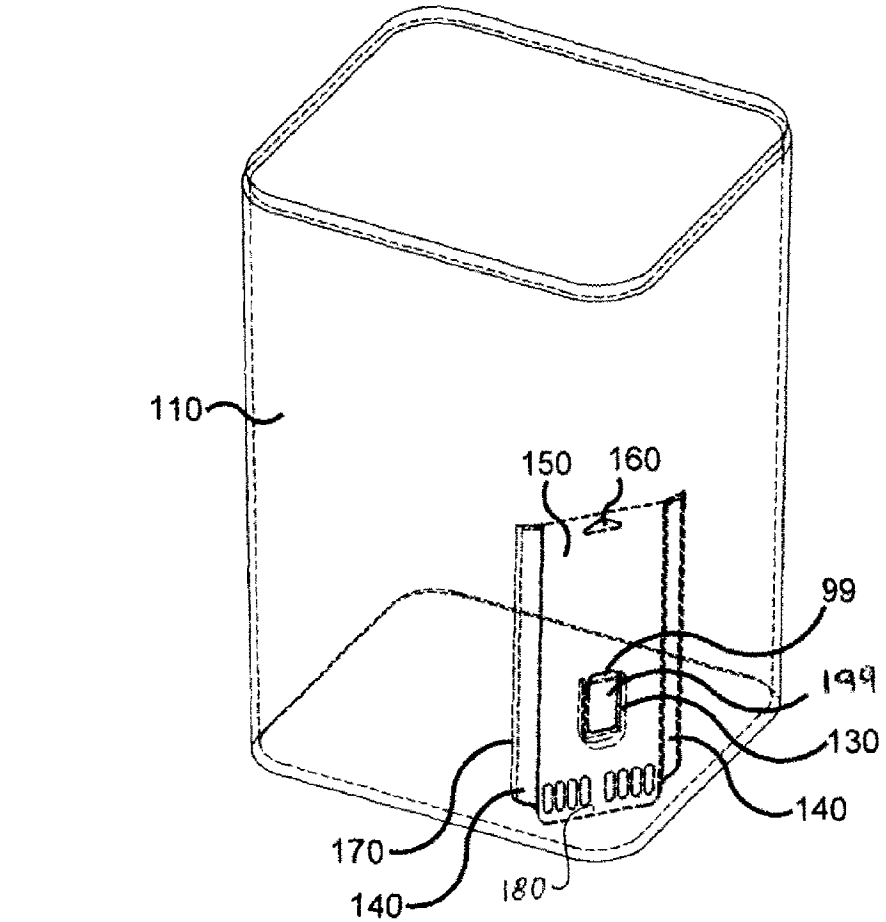
Figure 2:
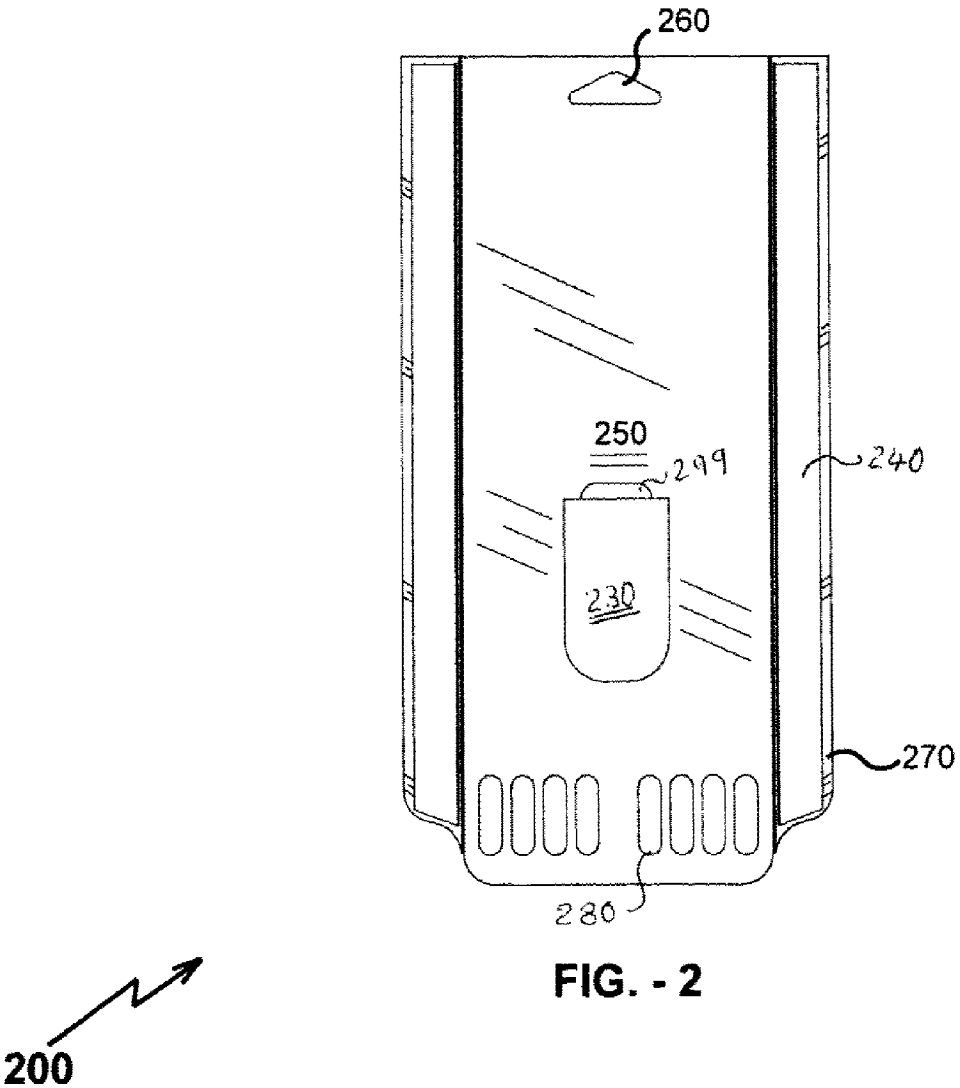
Figure 3B:
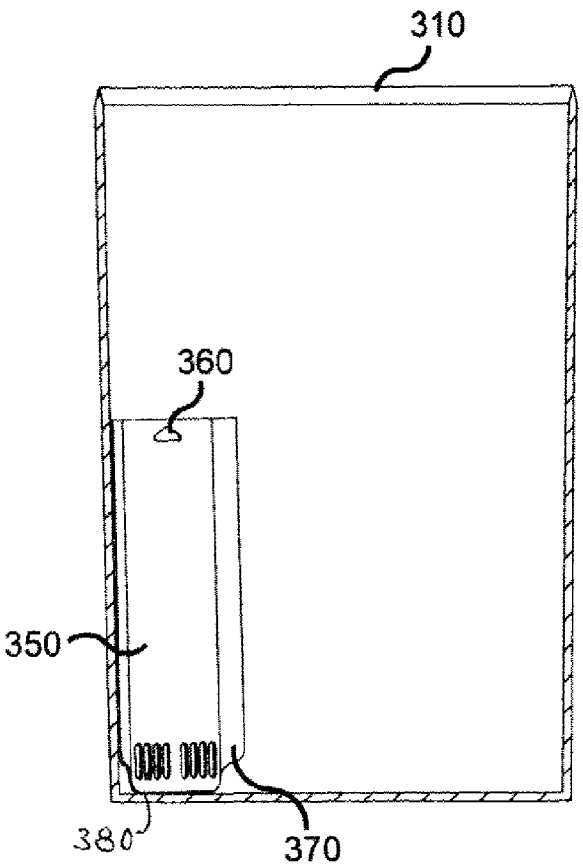
Figure 3A:
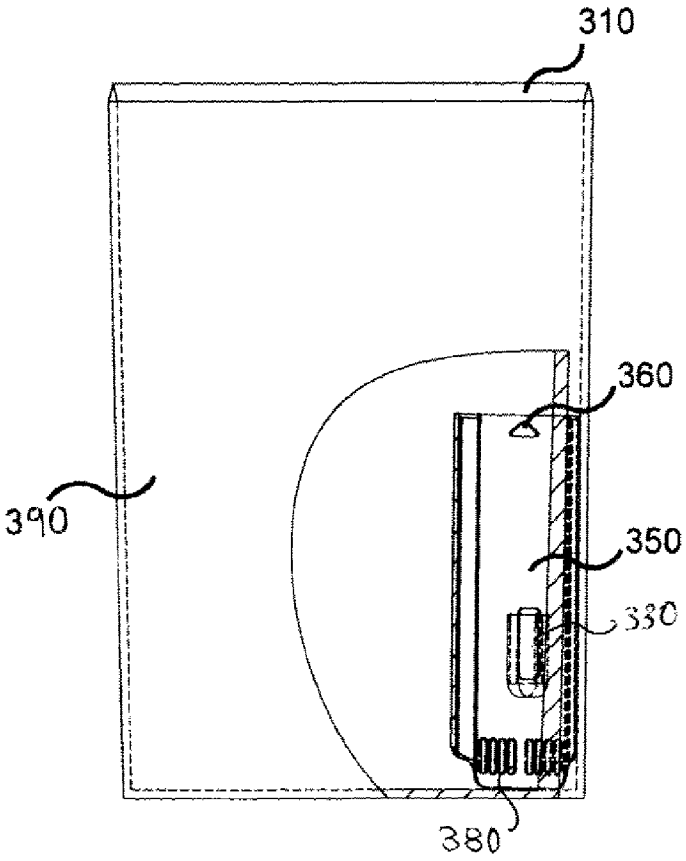
Figures 4A, 4B, 4C, 4D:
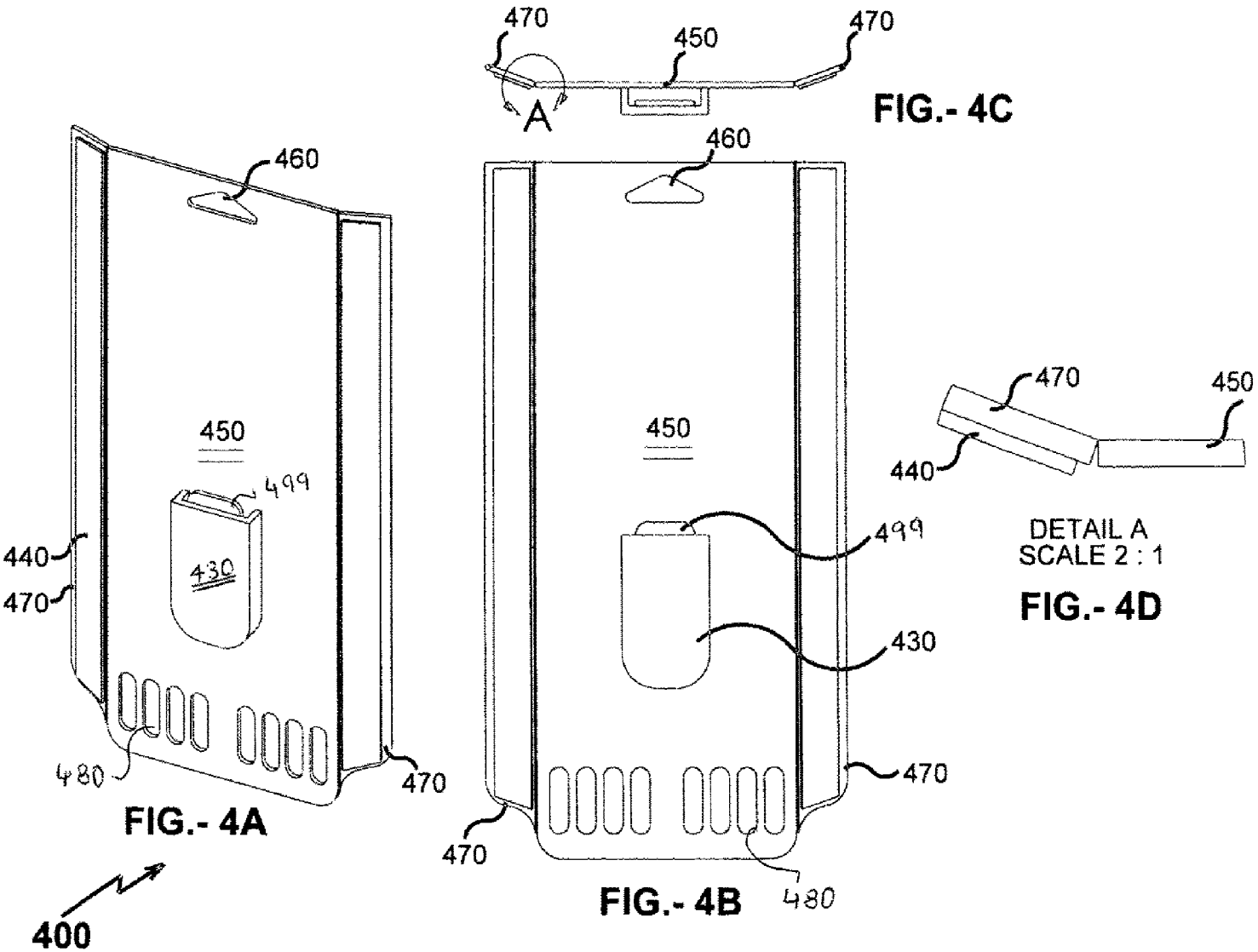
Figure 6:
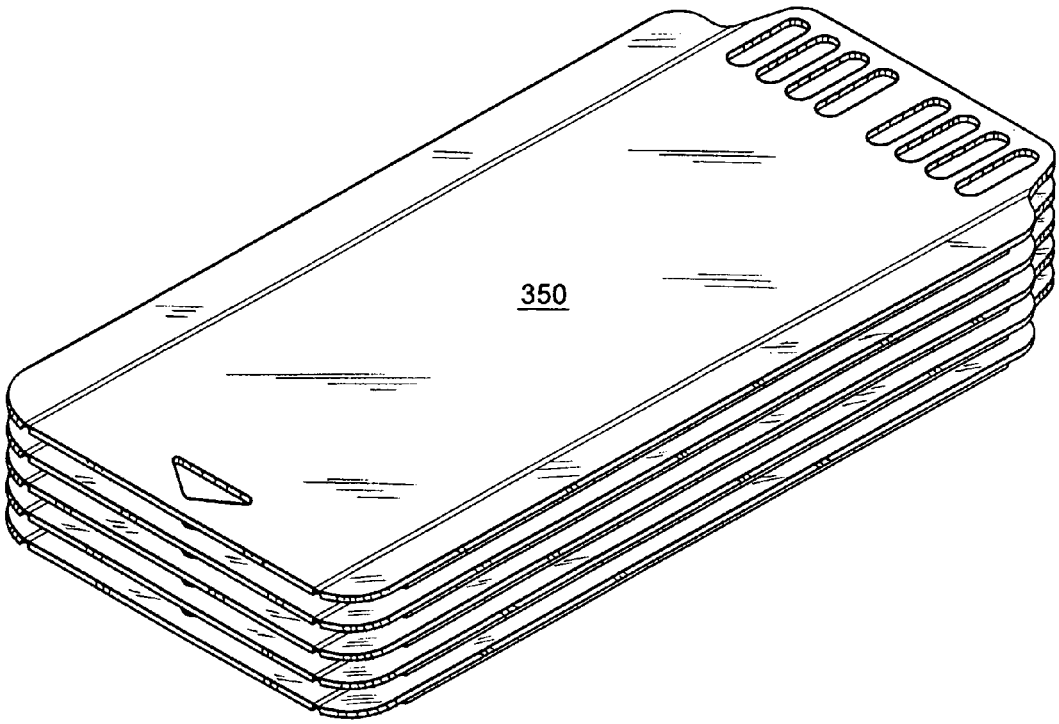

b) FIG. 1-B top plan view of the trash container of this invention with the divider diagonally position at the bottom of one corner of the trash can of FIG. 1-A.

c) FIG. 2 is the enlarged view of the Divider in greater detail d) FIG. 3-A is a side elevation of the trash can with cut-away to show the divider.

e) FIG. 3-B another side elevation of the trash can with cut-away to show the divider.

f) FIG. 4-A is an isometric 3-D view of the divider showing the air freshener holder wherein the air freshener holder is on opposite side of the bag, which is the smaller side of the container with the divider inserted therein.

g) FIG. 4-B shows the front plan view of the FIG. 4-A of the divider showing the air freshener holder wherein the air freshener holder is on opposite side of the bag, which is the smaller side of the container with the divider inserted therein.

h) FIG. 4-C the top plan view of the FIG. 4-A of the divider showing the air freshener holder wherein the air freshener holder is on opposite side of the bag, which is the smaller side of the container with the divider inserted therein.

i) FIG. 4-D shows detail A of FIG. 4-C in double scale which in turn is derivation of top plan view of the FIG. 4-A of the divider showing the air freshener holder wherein the air freshener holder is on opposite side of the bag, which is the smaller side of the container with the divider inserted therein.

j) FIG. 5-A is a side elevation of the trash can with trash bag inserted therein and with trashcan cut-away to show the divider.

k) FIG. 5-B an isometric 3-D perspective view of the trash can with trash bag inserted therein and with trashcan cut-away to show the divider diagonally positioned therein at the bottom of the front corner facing the observer (viewer & user)

l) FIG. 6 is a top perspective view of a nested stack of dividers of FIG. 3B.

DETAILED DESCRIPTION OF THE BEST MODE OF THE PREFERRED EMBODIMENT

The invention is a flat rectangular-like piece of plastic about, but not restricted to any specific dimensions. At the bottom of said plastic plate is a plurality of vents. Naturally the size would be proportional to the size of the trash container and the liner. Included or a pair of living hinges also known as hinged members running length wise down the sheet about one inch in from the edge, thus allowing each of the one inch or so sections to fold on an angle such as, but not limited to, FIG. 4.

There is then a double sided adhesive, Velcro/hook-and-loop, or any other form of bonding or sticking applied to one side of each of the hinged members of approximately one inch, but not limited to while not limited to any specific number or fraction of inch (es) folded pieces (flaps) allowing for temporary and or permanent adhering to the container such as, but not limited to illustrations of this specifications. This will become self explanatory after the detailed description of the preferred embodiment that now follows logically to this preamble.

As shown in the drawings wherein like numerals represent like parts throughout the several views and further wherein the first digit of the cross reference numbers represents the figure number and the last two digits represent the part or component number wherein:

FIG. 1-A is a 3 D isometric perspective of the trash container 110 of this invention with the divider in dotted lines diagonally positioned at the bottom of one corner of the trash can 110 complete with divider 150 having a pair of hinged members 170 with adhesive 140, an access member 160, plurality of vents 180, and a receptacle 130 for holding a prior art air freshener 99, 199. Similarly FIG. 1-B top plan view of the trash container 110 of this invention with the divider 150 diagonally positioned at the bottom of one corner of the trash can 110 of FIG. 1-A also showing a receptacle 130 for holding a prior art air freshener 99, 199

FIG. 2 is the enlarged view of the Divider 250 in greater detail delineating an access member 160, a pair of hinged members 270 each with adhesive 240, plurality of vents 280, and a receptacle 230 for holding a prior art air freshener 299.

FIG. 3-A is a side elevation of the trash can 310 with cut-away to show the bag 320, divider 350, access member 360 and plurality of air vents 380 at the bottom there of as well as a receptacle 330 for holding a prior art air freshener 99.

FIG. 3-B another side elevation of the trash can with cut-away to show the bag 390, divider 350, access member 360 and plurality of air vents 380 at the bottom there of.

FIG. 4-A is an isometric 3-D view of the divider 450 showing the a pair of hinged members 470 each with adhesive 440, plurality of vents 480, air freshener 99, 499 holder 430 wherein the air freshener holder is on opposite side of the bag (Not Shown), which is the smaller side of the container 410 when the divider 450 is inserted therein.

FIG. 4-B shows the front plan view of the FIG. 4-A of the divider 450 having a pair of hinged members 470 each with adhesive 440, plurality of vents 480, air freshener 99, 499 holder 430 wherein the air freshener holder is on opposite side of the bag (Not Shown), which is the smaller side of the container 410 when the divider 450 is inserted therein.

FIG. 4-C the top plan view of the FIG. 4-A of the divider 450 showing a pair of hinged members 470. FIG. 4-D shows detail A of FIG. 4-C in double scale which in turn is derivation of top plan view of the FIG. 4-A of the divider 450.

FIG. 5-A is a side elevation of the trash can 510 with trash bag 599 inserted therein and with trashcan cut-away to show the divider 550 complete with a access member 560, a pair of hinged members 570 each with adhesive 540 a plurality of vents 580 and an air freshener holder 530 for holding a prior art air freshener 599 therein.

FIG. 5-B an isometric 3-D perspective view of the trash can 510 with trash bag 599 inserted therein and with trashcan cut-away to show the divider 550 diagonally positioned therein at the bottom of the front corner facing the observer (viewer & user). The divider 550 is delineated complete with a access member 560, a pair of hinged members 570 each with adhesive 540 a plurality of vents 480 and an air freshener holder 530 for holding a prior art air freshener 599 therein.

The invention is an apparatus, channel, canal, hole, chamber, duct, flume, groove, opening, gutter, gullet, pipe, passage, vent, path, guide or anything or item (tangible or intangible) that that does not need to be enclosed or designed before or after the manufacturing process, built into or built separately, from any container that allows air to enter and exit from the bottom, side, top or any other part or identity of the container to the top, bottom, side, or any other part or identity of the container, including but not limited to entering or exiting through the handles, thus allowing removal or installation of a removable container such as but not limited to specifications and drawings shown here for illustrative purposes.

Some of the objectives of this invention are achieved by a liner or any other item or object, tangible or intangible, that would be easier installed, placed or removed with less resistance due to this invention (this explained system) by allowing more air, gas(s), liquid(s) or any other item(s) or object(s), tangible or intangible, by creating a vent that runs from the top.

It is not necessarily housed at the bottom of the container to reduce resistance by reducing suction while keeping leakage of liquids contained, but not limited to keeping them contained such as delineated in these specifications.

In summary it essentially comprises a piece of plastic(s) or any other type of material(s) which is designed and constructed specifically to attach to a container in a way in when doing so, creates an open airway that runs from, but not limited to, the inside bottom of the container and out through, but not limited to, the top or through any other part of the sides, brim, bottom or top of the container as shown in the accompanying drawings and specifications herein within the four corners of this instrument.

The inventor prefers and has shown for illustrative purposes a flat rectangular-like piece of plastic, about but not limited to, 7 inches wide and 12 inches long, (length and width can be made to the specifications of the size of the container to which it is applied) that has two indented grooves, living hinges, or any other type of bendable connection running length wise down the sheet about, but not limited to, 1 inch in from the edge, thus allowing each hinged member of about one inch width but not limited to, inch(es) sections to fold on an angle such as shown herein for illustrative purposes.

An inexpensive way to change any ordinary stationary containers such as, waste, paper, utility, leaf, household, commercial, plastic, metal, garbage can, trash can etc. or any other container of any size that allows air to flow from the top, side or any other part or identity, to the inside bottom of the container such as shown in various figures accompanying this specifications, but not limited to, that allows easy removal and/or installation of any item(s) that could fit, easily or forcefully. Typically the inventor envisages the use of garbage bag(s) or liner(s) and or any other thing(s), item(s) or container(s), while keeping any liquids from leaking out of the container.

Manufacture, Assembly & Use

The manufacturing, assembly and use of this invention is very simple even intuitive. Nonetheless the inventor recommends the following steps in summary form for the manufacture and assembly and use of this simple invention particularly for one of average skill in the art.

a) Attaching the partition vent by peeling off the protective adhesive backing to expose the adhesive provided for this purpose
b) Inserting the bag
c) Transporting trash can to the curbside for pick up
d) Trash hauling operators remove each bag easily and effortlessly
e) Relocating the trash can to its designated position
f) Inserting a clean bag
g) Repeating the process until the trash can needs to be replaced
h) Reusing and recycling the vent as practical under the circumstances or as a matter of user preference.

In the preferred embodiment the inventor attached the divider to the trash can by applying double sided adhesive, Velcro/hook-and-loop, or any other form of bonding or sticking to one side of each of the hinged members of approximately one inch but not limited to, one inch folded pieces allowing for temporary or permanent adhering to the container. The invention is then applied to the inside wall of the rectangular or round container.

The invention is then applied to the inside wall of the container such as, but not limited to, FIG. 6 which shows a rectangular container and FIG. 7 which shows a circular container, thus making a vent that runs vertical from, but not limited to, the bottom to the top of any shape or size container.

For production, a mold is needed to be set up in the dimensions that are wanted on the said piece of plastic, preferably but not limited to a thickness that will retain its flat shape while under pressure. If molded with the flaps, the flaps can be, but are not limited to be, thinner than the center piece, to enable them to bend to any curvature thus enabling a stronger bond the container wall. The flaps can also be molded separately and then attached.

After the molding process is complete double sided tape, Velcro, hook-and-loop, or any other type of permanent and or non permanent adhesive or bonding agent, is then applied to one side of each said 1, but not limited to, inch(es) foldable sections. The invention can also be molded as one with the container, as the container is being molded. After the molding process is complete the new container will have a flap that can be folded over and be locked into place to create a vent The inventor has given a non-limiting description of the system of this invention. Due to the simplicity and elegance of the design of this invention designing around it is difficult. Nonetheless many changes may be made to this design without deviating from the spirit of this invention. Examples of such contemplated variations include the following:

a) The shape and size, thickness and material used may be modified.
b) The color, aesthetics and materials may be enhanced or varied.
c) Additional complimentary and complementary functions and features may be added.
d) A more economical version and/or size of the device may be adapted.
e) A more upscale version of the device may be adapted.
f) Cloth, rubber or plastic or other suitable material of choice may be substituted.
g) Laser, adhesives, paint may be used to apply logos, decals and advertising promotional messages.
h) A DIY Kit version may be employed.
i) Any appropriate fastener such as snap, clip, ball & ring or VELCRO® Hook & Eye may be used for desired orientation and fixation of the divider.
j) The device may be adapted for other applications.
k) It may be incorporated into an OEM model.
l) The method of storing and stacking the containers, their lids and dividers and a may be varied.
m) Newer components may be substituted as they become available.
n) A rectangular container may be replaced by a different shape of container such as oval, circular etc.
o) The rectangular divider may be replaced by a different shape such as oval, circular etc.

Other changes such as aesthetics and substitution of newer materials as they become available, which substantially perform the same function in substantially the same manner with substantially the same result without deviating from the spirit of the invention may be made. Following is a listing of the components used in the best mode preferred embodiment and the alternate embodiments for use with OEM as well as retrofit markets. For the ready reference of the reader the reference numerals have been arranged in ascending numerical order.

| | |
|---|---|
| 099 = | Prior Art air freshener |
| 100 = | Embodiment of FIG. 1 generally |
| 110 = | Trash Container |
| 130 = | Holder |
| 140 = | Self-Stick fastener for flexibly hinged members |
| 150 = | Divider |
| 160 = | Divider access member such as a hook or hole |
| 170 = | A pair of hinged members |
| 180 = | A plurality of vents at the bottom of the divider 150 |
| 199 = | Prior art air freshener interface to holder |
| 200 = | Embodiment of FIG. 2 generally |
| 210 = | Trash container generally semi rigid |
| 230 = | Holder |
| 240 = | Self-Stick fastener for flexibly hinged members |
| 250 = | Divider |
| 260 = | Divider access member such as a hook or hole |
| 270 = | A pair of hinged members |
| 280 = | A plurality of vents at the bottom of the divider 250 |
| 300 = | Embodiment of FIG. 3 generally |
| 310 = | Trash container generally semi rigid |
| 330 = | Holder |
| 340 = | Self-Stick fastener for flexibly hinged members |
| 350 = | Divider |
| 360 = | Divider access member such as a hook or hole |
| 370 = | A pair of hinged members |
| 380 = | A plurality of vents at the bottom of the divider 350 |
| 390 = | Liner or Bag |
| 400 = | Embodiment of FIG. 4 generally |
| 410 = | Trash container generally semi rigid |
| 430 = | Holder |

-continued

| | |
|---|---|
| 440 = | Self-Stick fastener for flexibly hinged members |
| 450 = | Divider |
| 460 = | Divider access member such as a hook or hole |
| 470 = | A pair of hinged members |
| 480 = | A plurality of vents at the bottom of the divider 350 |
| 499 = | Air freshener of prior art |
| 500 = | Embodiment of FIG. 5 generally |
| 510 = | Trash container generally semi rigid |
| 530 = | Holder |
| 550 = | Divider |
| 560 = | Divider access member such as a hook or hole |
| 570 = | A pair of hinged members |
| 580 = | A plurality of vents at the bottom of the divider 350 |
| 590 = | Liner or Bag |
| 599 = | Air freshener of prior art |

DEFINITIONS AND ACRONYMS

A great care has been taken to use words with their conventional dictionary definitions. Following definitions are included here for clarification.

| | |
|---|---|
| 3D = | Three dimensional |
| AKA = | Also Known As |
| Combo = | Contraction for combination |
| DIY = | Do It Yourself |
| GH = | Grabber Hook(s) such as #160, 260, 560 |
| Integrated = | Combination of two entities to act like one |
| Interface = | Junction between two dissimilar entities |
| MTBF = | Mean Time Between Failure |
| OEM = | Original Equipment Manufacture |
| Symmetrical = | Mirror image along an axis or Front and back reversible &/or Left Right reversible |

The reader can now readily see how the above detailed description results in the following benefits of the invention over the prior art.

1) Secure and Long lasting
2) Affordable and Cost effective
3) Simple elegant sleek aesthetic design
4) Ease of manufacture, use and operation
5) Self reliant that it can be used without assistance of another person.
6) User Friendly and intuitive
7) Requires no additional training
8) Suitable for people of all ages and gender in all types of situations.
9) Multiple uses in a wide range of situations and circumstances.
10) Easy automatic means for measuring
11) Cost effective and affordable.
12) Intuitive to use and operate without additional skills or training.
13) Water resistant, spill proof and leak proof.
14) Fool proof though not idiot proof
15) Suitable for people with special needs such as cane, prosthetics.
16) Modular and compact for ease of carrying and storing.
17) Portable, foldable and small foot print
18) Consolidation for saving time and energy.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

The inventor claims:

1. A divider device for emplacement within the interior of a plastic trash container of vertically upright configuration designed to accommodate a removable trash-receiving plastic bag which rests upon the interior floor of said container, the purpose of said device being to facilitate the upward removal of said bag when trash-laden, said device comprising:

a) a panel of monolithic plastic construction having a substantially rectangular configuration bounded by flat front and rear faces, upper and lower edge extremities whose distance of separation defines the height of the device, and opposed parallel side edge extremities whose distance of separation define the width of said device and further define a central region and a resultant centered orthogonal plane of symmetry, b) a line of structural weakness located inwardly from each side extremity and parallel thereto and extending the full height of said central region, said structural weakness constituting a living hinge and defining a region between said hinge and said side edge extremity as a flap capable of flexural movement forwardly of the front face of said central region, c) a series of apertures in said central region adjacent said lower edge extremity, and d) a strip of double-sided adhesive tape attached to the rear face of each flap, and a protective release paper on each of said strips, whereby e) the device is adhesively attachable to the interior wall of said trash container adjacent the bottom thereof, bridging a corner of a rectangular container or spaced apart sites of a circular container to produce a passageway between the rear face of the device and the interior wall of said container, said passageway allowing air to enter said container and thereby preventing formation of a vacuum when said bag is lifted from said container.

2. The device of claim 1 wherein said height is about 12 inches, said width is about 7 inches, and the width of said flaps, measured between said hinge and associated side edge, is about one inch.

3. The device of claim 1 wherein said apertures are elongated in the length direction of said central region.

4. The device of claim 1 wherein said flaps are slightly angled toward said central region even before flexural movement thereof, thereby permitting stabilized nesting of a stack containing a number of said devices.

5. A nested stack of a multitude of devices of claim 4.

6. In combination, a plastic trash container of vertically upright configuration, a divider device of claim 1 adhesively secured within said container in a manner to provide an air passageway toward the bottom of said container, and a trash-receiving compliant plastic bag removably held within said container having said divider device.

* * * * *